United States Patent [19]

McFarland

[11] Patent Number: 4,867,716

[45] Date of Patent: Sep. 19, 1989

[54] BOAT

[76] Inventor: Douglas F. McFarland, Route 1, Davis City, Iowa 50065

[21] Appl. No.: 194,209

[22] Filed: May 16, 1988

[51] Int. Cl.[4] ..... B63H 1/26

[52] U.S. Cl. ..... 440/48; 440/30; 440/98

[58] Field of Search ..... 440/48, 21, 26–31, 440/95, 98

[56] References Cited

U.S. PATENT DOCUMENTS

| | | | |
|---|---|---|---|
| 619,224 | 2/1899 | Rasmussen | 440/48 |
| 812,604 | 2/1906 | Sitzler | 440/48 |
| 868,183 | 10/1907 | Heggen | 440/48 |
| 872,140 | 11/1907 | Mikulasek | 440/48 |
| 1,000,076 | 8/1911 | Cracroft | 440/48 |
| 1,134,670 | 4/1915 | Cizek | 440/48 |
| 1,321,304 | 11/1919 | Hamilton | 440/48 |
| 1,445,467 | 2/1923 | Baer | 440/48 |
| 1,646,611 | 10/1927 | Cole | 440/48 |
| 2,154,191 | 4/1939 | Welsh | 440/48 |
| 2,381,622 | 8/1945 | Sheppard | 440/48 |

*Primary Examiner*—Sherman D. Basinger
*Assistant Examiner*—Clifford T. Bartz
*Attorney, Agent, or Firm*—Zarley, McKee, Thomte, Voorhees & Sease

[57] ABSTRACT

The present invention includes a boat having a pair of rotatable elongated pontoons on opposite sides thereof. Each of the pontoons has helical flighting for propelling the boat during rotation of the pontoon. The pontoon also is filled with floatation materials so as to add to the buoyancy of the vehicle. Each pontoon is independently rotatable so as to achieve maneuverability even without a rudder.

A modified form of the present invention utilizes two independently rotatable paddle wheels.

14 Claims, 3 Drawing Sheets

10-10

BOAT

BACKGROUND OF THE INVENTION

This invention relates to an improved boat.

Recreational boats have been provided in the past which can be manually powered or powered by foot pedal to drive a paddle or other means for propelling the boat. These prior boats usually require separate flotation means to provide sufficient buoyancy to float the boats. Also, they usually require a rudder or steerage mechanism in order to control the direction of the boat.

Therefore, a primary object of the present invention is the provision of an improved recreational boat.

A further object of the present invention is the provision of an improved boat which integrates the propulsion unit with a floatation device.

A further object of the present invention is the provision of an improved boat which operates with or without a rudder.

A further object of the present invention is the provision of an improved boat which has two propulsion units which also function as floatation devices and as steering mechanisms, and which can steer the boat merely by operating the two propulsion units in opposite rotational directions.

A further object of the present invention is the provision of an improved recreational boat which has increased maneuverability over prior manually powered boats.

A further object of the present invention is the provision of an improved boat which has a manual propulsion system which increases the speed over prior manual propulsion systems.

A further object of the present invention is the provision of an improved boat having a propulsion device which increases the surface area that is in contact with the water compared to a typical paddle boat.

A further object of the present invention is the provision of an improved boat having a propulsion system which translates the riders physical energy more directly into forward or reverse motion.

A further object of the present invention is the provision of a device which is economically to manufacture, durable in use and efficient in operation.

SUMMARY OF THE INVENTION

The present invention comprises a rectangular boat frame having a pair of elongated hollow tubes rotatably mounted on opposite sides thereof. Each of the hollow tubes includes an elongated spiral flighting extending around the outer surface thereof. Foot pedals are mounted on the device and are drivingly connected to the two rotatable tubes for causing the tubes to rotate. The rotation of the tubes causes the flighting to engage the water and move the boat through the water.

Two separate pedal systems are provided on the boat, one of which is connected to one of the elongated tubes and the other which is connected to the other elongated tube. Thus, it is possible to operate the tubes in opposite rotational directions so as to cause the boat to turn in a short radius. Since each of the two elongated tubes can be turned independently, the boat is extremely maneuverable even without a rudder.

Furthermore, the use of a spiral drive encircling the tubes increases the surface area of the propulsion unit that is in contact with the water compared to a typical paddle boat. The spiral pontoon drive also maintains constant, firm contact between the water and the drive. As a result, the boat is easier for the individual to propel, and unlike paddle boats that quickly reach a maximum speed, the rider's energy translates more directly into forward or reverse motion.

A modified form of the present invention includes a pair of paddle wheels which are mounted at the rear of the vehicle. Each of the paddle wheels is hollow so as to provide buoyancy to the vehicle. The paddle wheels include paddles on their outer surfaces for engaging the water and driving the vehicle.

Each of the paddle wheels is independently operated and is driven by a separate foot pedal system. Thus, it is possible to steer the device without a rudder merely by operating the two paddles at different speeds or in opposite directions.

While both of the above described devices may be operated without a rudder, it is also possible to provide a rudder, and to provide means for locking the two drive mechanisms together so that they operate in unison. When they are locked together it is possible for one person to operate the device. However, the ability to operate the two pedal systems independently is very desirable for most recreational boats since the boats are often operated by two people.

BRIEF DESCRIPTION OF THE DRAWINGS

FIG. 6 is a perspective detail of the rudder mechanism of the present invention.

DETAILED DESCRIPTION OF THE PREFERRED EMBODIMENT

Figure 2:
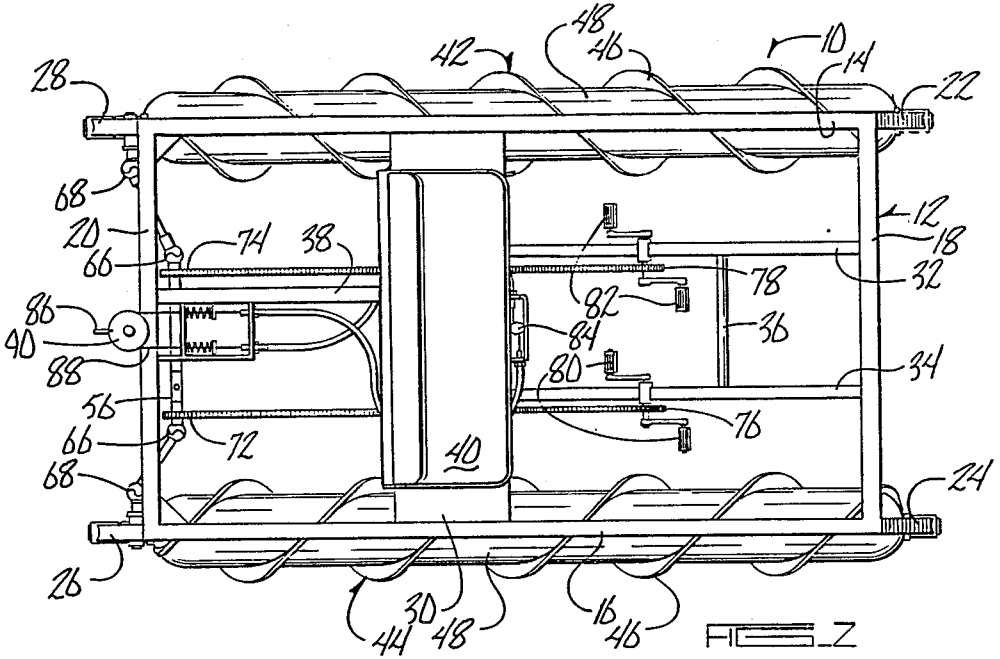
FIG. 2 is a top plan view thereof.
Figure 3:
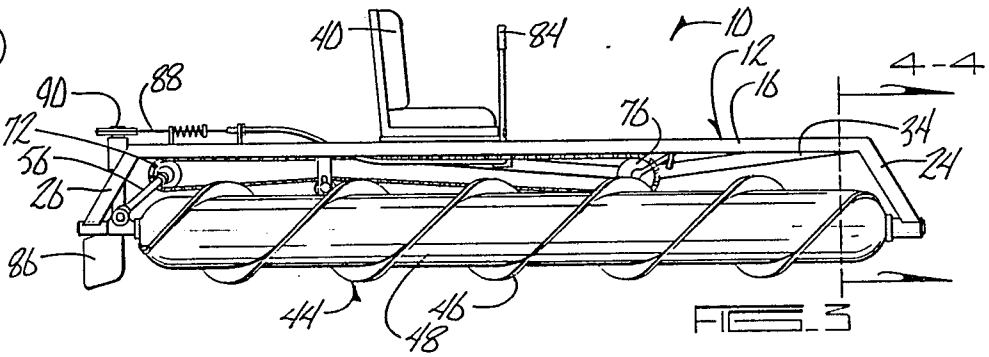
FIG. 3 is a side elevational view thereof.
Figure 1:
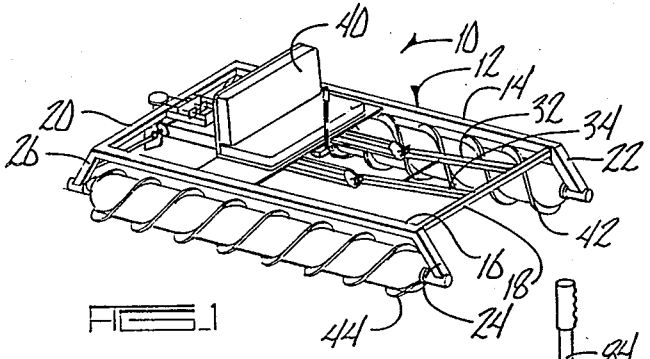
FIG. 1 is a perspective view of the preferred embodiment of the present invention.

Referring to FIGS. 1-6, the numeral 10 generally designates the preferred embodiment of the boat of the present invention. Boat 10 comprises a rectangular frame 12 having a pair of side frame members 14, 16, a forward frame member 18 and a rear frame member 20. Angling downwardly from the four corners of rectangular frame 12 are four pontoon support members 22, 24, 26, 28. Extending from side frame member 14 to side frame member 16 is a seat support frame 30. Extending from seat support frame 30 to front frame member 18 are a pair of sprocket support members 32, 34 which are joined by a cross-support 36. Extending rearwardly from seat support frame 30 to rear frame member 20 is a further support frame member 38. Mounted on seat support frame 30 is a seat 40.

Figure 4:
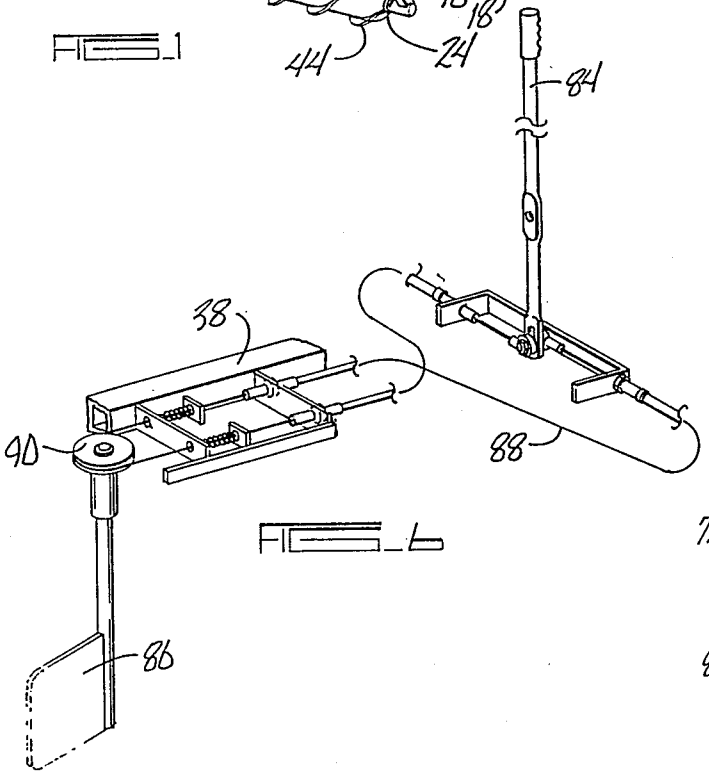
FIG. 4 is a section view taken along line 4—4 of FIG. 3.
Figure 4:
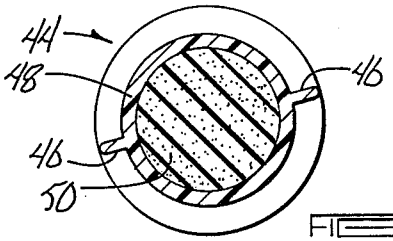

A rotatable pontoon 42 is rotatably journaled between pontoon supports 22, 28, and an identical pontoon 44 is rotatably journaled between pontoon supports 24, 26. Pontoons 42, 44 each are elongated and cylindrical in shape and each include a helical flighting 46 extending helically around the outer cylindrical surfaces thereof. As can be seen in FIG. 4, the pontoons 42, 44 each comprise an elongated cylindrical tube 48 which is hollow. The hollow core of tube 48 may contain air or it may be provided with a conventional floatation material such as designated by numeral 50 in FIG. 4. The pontoons 42, 44, because of their hollow construction, impart buoyancy to the vehicle so that it will float. In addition, because of the helical flightings 46, the pontoons 42, 44 are capable of being rotated to cause propulsion of the vehicle in the water.

Figure 5:
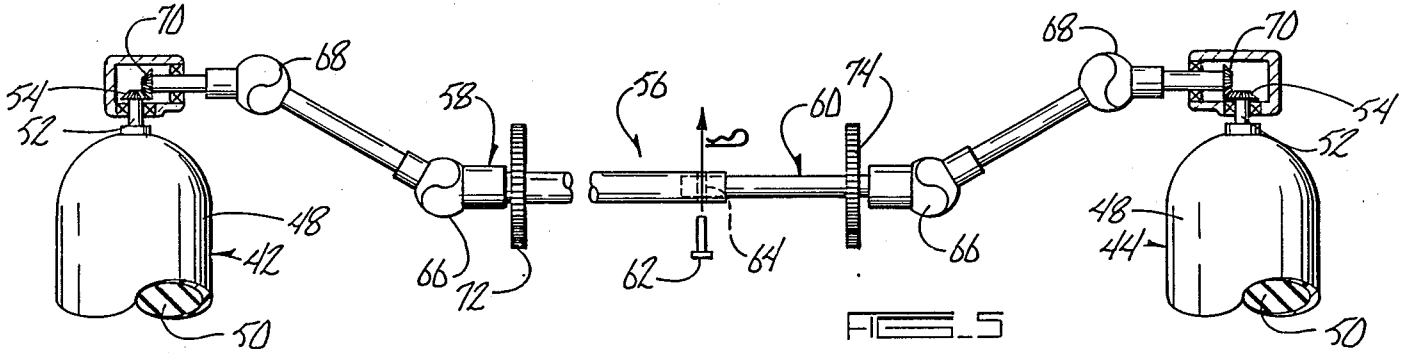
FIG. 5 is a enlarged detail view of the drive mechanism for the two pontoons.

Referring to FIG. 5, each of the pontoons 42, 44 include at their rearward ends a stub shaft 52 upon which is carried a beveled gear 54. An elongated drive shaft 56 is comprised of a first section 58 and a second section 60 which are telescopically mounted with respect to one another. FIG. 5 illustrates a pin 62 which may optionally be inserted into a locking hole 64 for preventing rotation of drive shaft sections 58, 60 with respect to one another. However, it is also possible to remove pin 62 so that the two drive shaft sections 58, 60 can rotate independently of one another. Drive shaft sections 58, 60 include universal joints 66, 68 therein, and terminate in beveled gears 70 at their opposite ends. Beveled gears 70 are drivingly engaged with beveled gears 54 so that rotation of drive shaft sections 58, 60 causes corresponding rotation of pontoons 42, 44. Mounted to drive shaft section 58 is a first sprocket 72 and mounted to drive shaft section 60 is a second sprocket 74. These sprockets 72, 74 are drivingly connected to first and second pedal sprockets 76, 78 which are rotatably mounted to frame members 32, 34 adjacent and forwardly of seat 40. Pedal sprocket 76, 78 are connected to foot pedals 80, 82, respectively, which can be rotated by the operator sitting on seat 40.

It is possible to operate boat 10 without the use of any kind of rudder or steerage mechanism other than the foot pedals 78, 80. The drawings show a rudder control 84 which controls a rudder 86, but it is possible to totally eliminate such a rudder control and rudder system. Instead, all that is necessary is to remove pin 62 so that pedals 82 rotate shaft section 60 and pontoon 42 independently from the other pedals and pontoon. Similarly, pedals 80 independently operate pontoon 44. It is thus possible to rotate pontoon 42 in one direction while at the same time rotating pontoon 44 in the opposite direction to attain the desired turning or maneuverability of the boat.

However, in some situations, it may be desirable to have a rudder system, and therefore one is shown in the drawings for illustrative purposes. The rudder system includes a rudder control lever 84 which is connected by a control cable 88 to a pulley 90 at the upper end of rudder 86. Tilting of the lever 84 to the left or right causes corresponding rotation of the rudder 86 for steerage.

Figures 7, 8, 9, 10:
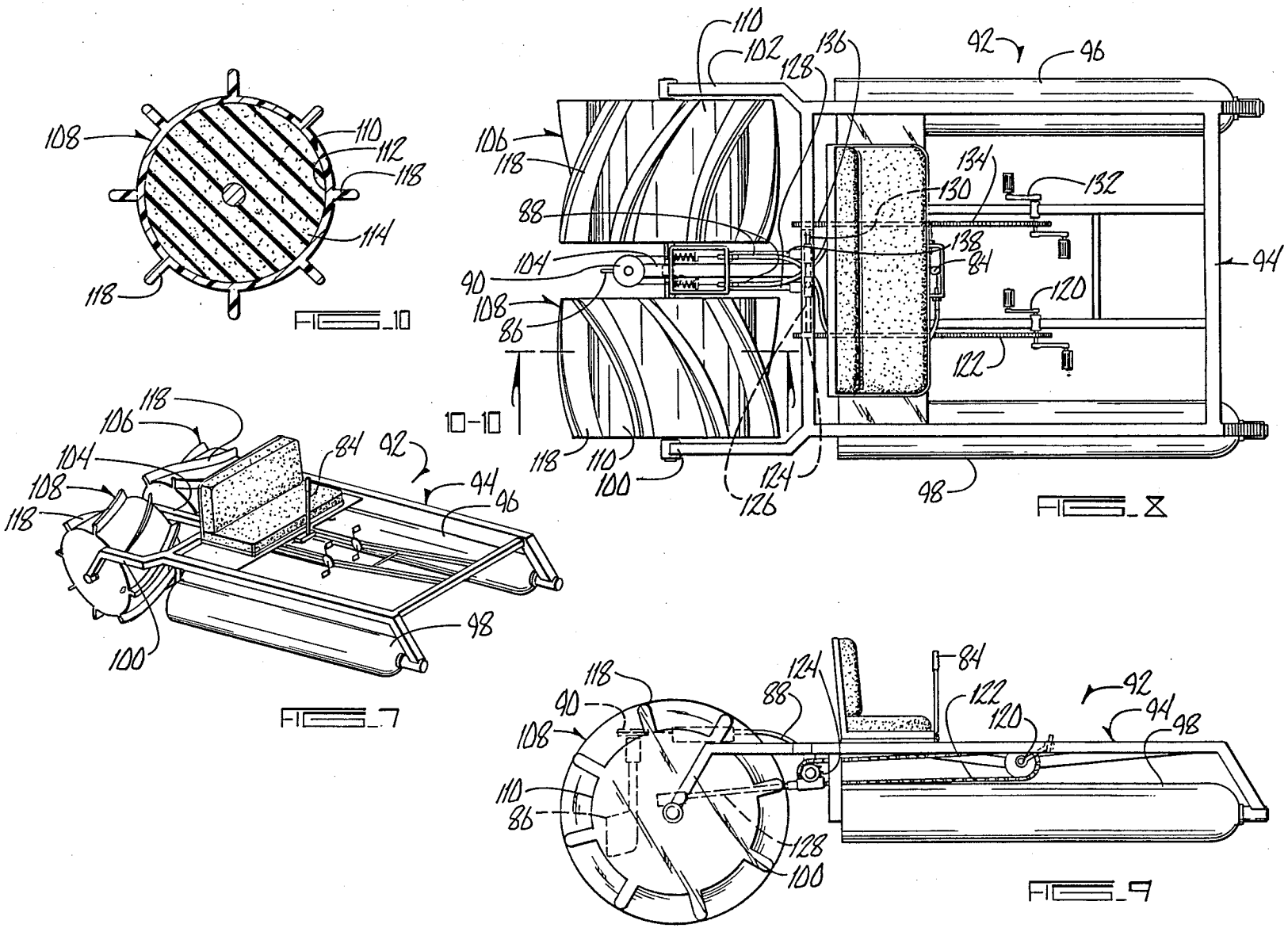
FIG. 7 is a perspective view of a modified form of the present invention.
FIG. 8 is a top plan view thereof.
FIG. 9 is a side elevational view thereof.
FIG. 10 is a sectional view taken along line 10—10 of FIG. 8.

Referring to FIGS. 7-9 a modified form of the invention is shown and is designated by the numeral 92. Boat 92 includes a rectangular frame 94 having a pair of stationary pontoons 96, 98 mounted at the opposite sides thereof. Extending rearwardly from frame 94 are a pair of rear extension frame members 100, 102 and a central extension frame member 104. Rotatably mounted between central extension 104 and extension 102 is a first paddle 106, and rotatably mounted between extension 104 and extension 100 is a second paddle 108. Each paddle 106, 108 comprises a cylindrical wall 110 which encloses a floatation chamber 112. Chamber 112 may contain air only or may be provided with conventional floatation material such as designated by the numeral 114 so that paddles 106, 108 cooperate with pontoons 96, 98 to provide buoyancy to the boat 92. Mounted on the outer cylindrical surface of cylindrical wall 110 are a plurality of paddle blades 118. As can be seen in FIGS. 7 and 8, blades 118 are angled with respect to the rotational axes of paddles 106, 108. Preferably the angling of blades 118 in paddle 106 should be opposite from the angling of the blades 118 in paddle 108 so as to counterbalance the tendency of the angled blades 118 to move the boat laterally.

Paddle 108 is driven by a foot pedal sprocket 120 which is connected by a chain 122 to a sprocket 124 on a drive shaft section 126 which in turn drives a rearwardly extending shaft 128 for driving paddle 108.

Drive shaft section 126 is telescoped over a corresponding drive shaft section 130 in the same manner as shown in FIG. 5 for the two drive shaft sections 58, 60. Drive shaft section 130 is driven by a foot pedal sprocket 132 and chain 134 which are trained around a sprocket 136 on shaft 130. Shaft 130 in turn drives a rearwardly extending shaft 138 which in turn drives paddle 106. Because of the telescoped relationship of drive shaft sections 130, 126, it is possible to operate the two paddles 106, 108 independently by removal of a pin (not shown) similar to the pin 62 in FIG. 5. With the pin removed the two paddles operate independently, and if desired, the pin can be inserted to lock the two shafts 130, 126 together and cause the two paddles to rotate in unison.

Thus, with the pin removed it is possible to achieve maneuverability of the vehicle 92 without the need for a rudder system. However, a rudder system may be included for use when the two shafts are locked together, and a rudder system is shown for illustrative purposes in FIGS. 7-10. The rudder system used with boat 92 is the same as the one used with boat 10 and therefore corresponding numerals are utilized for the rudder system in boat 92.

The present invention provides several advantages not achieved with prior devices. The spiral flighting of the device shown in FIGS. 1-6 increases the speed of the vehicle because the spiral drive encircling the pontoons increases the surface area of the propulsion unit that is contact with the water compared to a typical paddle boat. The spiral pontoon drive also maintains constant, firm contact between the water and the drive. As a result, the boat is easier for individuals to propel. Unlike paddle boats that quickly reach a maximum speed, the riders energy in the present invention translates more directly to forward or reverse motion. Since each of the two pontoons can be turned independently the boat is also extremely maneuverable even without a rudder.

Similarly, the device shown in FIGS. 7-10 has the same maneuverability characteristics. In both of the devices shown in the drawings, the buoyancy of the boat is greatly enhanced by virtue of the fact that the drive mechanism, i.e. the pontoons 42-44 or the paddles 106-108, include floatation devices which add to the buoyancy of the device. Thus, it can be seen that the present invention accomplishes at least all of its stated objectives.

What is claimed is:

1. A boat for use on a body of water comprising:

an elongated boat frame having a longitudinal axis, a forward end, a rearward end and first and second opposite sides;

first and second rotatable drive means rotatably mounted to said frame for rotation about first and second axis and having blade means thereon, said first and second drive means being independently rotatable on said boat frame to cause said blade means to engage said water and propel said boat frame through said water;

said first and second drive means each comprising a cylindrical body having an outer cylindrical surface and having a float chamber therein imparting buoyancy to said boat frame, said blade means being attached to said outer cylindrical surface of said cylindrical body;

first power means drivingly connected to said first drive means for causing rotation thereof about said first axis;

second power means drivingly connected to said second drive means for causing rotation thereof about said second axis; and said first and second means each being reversible and operate independently of one another whereby said first and second power means are capable of selectively rotating said first and second drive means in opposite directions simultaneously at selected times and in the same direction simultaneously at other selected times.

2. A boat according to claim 1 wherein said blade means comprise a helical flighting attached to and extending helically around said cylindrical surface of said drive means.

3. A boat according to claim 2 wherein said first and second rotational axes of said first and second drive means extend parallel to said longitudinal axis of said boat frame.

4. A boat according to claim 3 wherein said first axis of said cylindrical body of said first drive means is located adjacent said first side of said boat frame and said second axis of said cylindrical body of said second drive means is located adjacent said second side of said boat frame.

5. A boat according to claim 4 wherein said first and second cylindrical bodies are elongated and have first and second cylindrical axes extending in a line parallel to said longitudinal axis of said boat frame.

6. A boat according to claim 1 wherein said first and second power means are selectively operable independent of one another whereby one of said first and second drive means is selectively capable of rotation while the other drive means is not rotated.

7. A boat according to claim 1 wherein coupling means extend between said first and second power means, said coupling means including locking means movable from a first position wherein said first and second power means are disconnected from one another and operate independently of one another to a second position locking said first and second power means together for operation in unison with one another.

8. A boat according to claim 1 wherein said first and second rotational axes of said first and second drive means extend perpendicular to said longitudinal axis of said frame.

9. A boat according to claim 8 wherein blade means of said first and second drive mans each comprise a plurality of blades positioned in circumferential spaced relation around the circumference of said outer cylindrical surface of said cylindrical body.

10. A boat according to claim 9 wherein said first and second drive means are positioned in side by side relation and said first and second rotational axes thereof coincide.

11. A boat according to claim 10 wherein said plurality of blades of said first drive means and said plurality of blades of said second drive means are at an angle with respect to said first and second rotational axes.

12. A boat according to claim 1 wherein said frame is free from having a rudder for steering.

13. A boat according to claim 1 comprising rudder means pivotally mounted to said frame, rudder control means connected to said rudder means for selectively moving said rudder means to steer said boat in said water.

14. A boat according to claim 1 wherein said first and second power means are independently operable at varying speeds whereby said first and second drive means are selectively capable of rotating at different speeds with respect to one another.

* * * * *